US005582405A

United States Patent [19]

Montgomery

[11] Patent Number: 5,582,405

[45] Date of Patent: Dec. 10, 1996

[54] HOCKEY STICK

[76] Inventor: Robert D. Montgomery, 1685 W. 12th St., Reno, Nev. 89503

[21] Appl. No.: 618,799

[22] Filed: Mar. 20, 1996

[51] Int. Cl.[6] ..... A63B 59/14

[52] U.S. Cl. ..... 273/67 A

[58] Field of Search ..... 273/67 A

[56] References Cited

U.S. PATENT DOCUMENTS

| | | | |
|---|---|---|---|
| 3,489,412 | 1/1970 | Franck et al. | 273/67 A |
| 3,561,760 | 2/1971 | Klay | 273/67 A |
| 3,563,546 | 2/1971 | Daive | 273/67 A |
| 3,720,410 | 3/1973 | Saytar | 273/67 A |
| 4,452,451 | 6/1984 | Dubreuil | 273/67 A |
| 4,570,932 | 2/1986 | Cote | 273/67 A |
| 4,664,379 | 4/1987 | Melby | 273/67 A |
| 4,799,682 | 1/1989 | Hughes | 273/67 A |
| 5,078,396 | 1/1992 | Cavallaro et al. | 273/67 A |
| 5,263,711 | 11/1993 | Addis et al. | 273/67 A |

*Primary Examiner*—Mark S. Graham

[57] ABSTRACT

A hockey stick is herein disclosed which is in conformance with the regulations required by hockey officials and the stick is so formed as to provide a longitudinal concave curved portion on the blade on the forehand side and a partial longitudinal concave curve on the blade on the backhand side, with at least a portion of each curve being substantially opposite each other.

4 Claims, 1 Drawing Sheet

HOCKEY STICK

FIELD OF THE INVENTION

This invention pertains to hockey sticks and more particularly to blade designs which have a curve on their forehand and backhand side.

BACKGROUND OF THE INVENTION

For many years hockey players have been using hockey sticks having curves in the blade on the forehand side. This forehand curve enables players to project a hockey puck with greater accuracy on a forehand shot, as compared to a stick with no curvature, known as a neutral stick. For various reasons, the curvature of hockey stick blades has now been restricted by hockey officials.

While curved sticks improve forehand shots for most hockey players, they simultaneously increase the difficulty of projecting a puck with a backhand shot. This is due to fact that, because of the concave forehand curve, there is less flat blade area on the backhand side to use for hitting or slapping the puck. Furthermore, the forehand curve makes it more difficult to hold or control the puck from the backhand side. This is particularly true for school-aged players.

The standard design for a hockey stick comprises an elongated handle or shaft portion disposed at approximately a 90 degree or slightly greater angle with respect to the handle. These sticks are commonly made of wood, plastic, or composite materials such as fiberglass. It has been common to blades that are curved in a forwardly direction to improve puck control and forward shooting ability. The disadvantage of a curved blade, however, is that the curvature adversely affects backhand shots because the puck may slide or be deflected off the convex rear surface instead of being squarely hit in the desired direction of travel.

Recently, this problem has been addressed by the development of dual-blade hockey sticks comprising a split or bifurcated blade in which the front (forward-facing) blade toe is forwardly concave and the rear (rear-facing) blade toe is substantially flat. Such dual-blade hockey sticks are described in U.S. Pat. No. 4,570,932 issued to George R. Cote and U.S. Pat. No. 4,793,613 and U.S. Pat. No. 4,799,682 each issued to Owen P. Hughes.

The Cote patent utilizes a wedge of relativity soft material positioned at the tip of the blade in order to create a winged tip resulting in a forward surface curvature while retaining a more or less flat rear surface while each of the Hughes patents describe a dual-blade hockey stick in which there is no separating spacer or wedge between the "toes" of the blade (as in the Cote stick) thereby, permitting the forward and rear toes to flex independently.

Most ice hockey blades are laminated with wood and/or fiberglass. The individual laminae or plies are held together with some type of adhesive bond. These adhesive-type bonds work fine when supporting in-plane shear loads but not the inherent tensile load associated with the dual-blade sticks, especially where the forward and rear toes flex independently as in the Hughes hockey stick. On the other hand, street hockey sticks are typically molded in plastic as one material.

For both laminated and molded constructions however, an open V-shaped blade is extremely susceptible to fracture. Out-of-plane (plane of blade) or through-the-thickness tensile stresses cause fracture by the formation of cracks or delimitations between the separate blades originating near the root of the V-joint and propagating towards the heel. A fulcrum effect was found to exist in the vicinity of the V-joint. In other words, displacement of points located before the root would be opposite in sense from those located beyond the root. Blade forces resulting from slapshots, backhand shots, and so forth, induced out-of-plane tensile stresses localized in the vicinity of the root. These detrimental tensile stresses are an inherent characteristic of the bifurcated blade geometry and exist in both laminated (ice) and molded (street) hockey blades.

Indeed, recent experience with the existing dual-blade hockey stick has confirmed that in use these sticks have a relatively short and unsatisfactory playing life. Stresses and strains generated by repeated striking of the hockey puck, other players sticks, the ice (or ground), and so forth rapidly lead to stress fractures at and behind the point of bifurcation or crotch of the dual-blade leading to eventual separation and premature failure.

OBJECTS OF THE INVENTION

A principal object of this invention is to provide an improved hockey stick having a longitudinal concave curve on the forehand side of the blade and a partial longitudinal concave curve on the backhand side of the blade.

A further object is to provide a hockey stick which conforms to the regulations now enforced by hockey officials as follows;

(a) The sticks shall be made of wood or other material approved by the rules committee, and must not have any projections. Adhesive tape of any color may be wrapped around the stick at any place for the purpose of reinforcement or to improve control of the puck.

(b) No stick shall exceed sixty inches in length from the heel to the end of the shaft nor more than twelve and one-half inches from the heel to the end of the blade.

The blade of the stick shall not be more than three inches in width at any point nor less than two inches. All edges of the blade shall be bevelled.

The curvature of the blade of the stick shall be restricted in such a way that the distance of a perpendicular line measured from a straight line drawn from the base of the heel to the base of the toe to the point of maximum curvature shall not exceed one-half inch.

(c) The blade of the goalkeepers stick shall not exceed three and one-half inches in width; nor shall the goalkeepers blade exceed fifteen and one-half inches in length from the heel to the end of the blade.

The widened portion of the goalkeeper's stick extending up the shaft from the heel where it must not extend more than twenty-six inches from the heel and shall not exceed three and one-half inches in width.

Still a further object is to provide a partial concave curve on the backhand side which does not form an illegal pocket.

Yet another object is to use the natural construction of the stick and blade to form both curves.

A further object of the present invention is to provide a forehand longitudinal concave curved portion on the blade which has a portion of its curve at least partially opposite a backhand partial longitudinal concave curved portion on the blade.

DETAILED DESCRIPTION OF THE DRAWINGS

Figure 2:
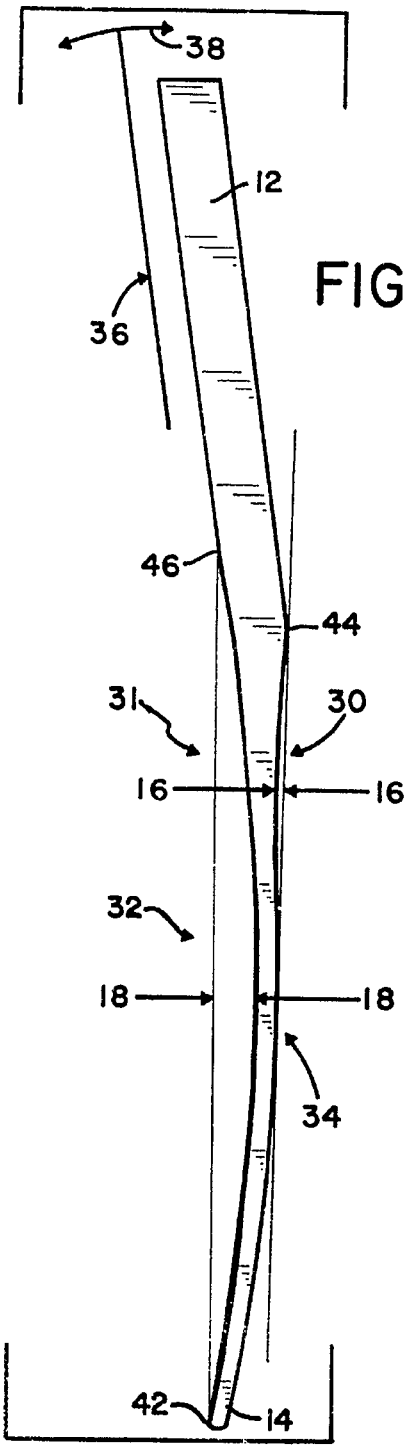
FIG. 2 is a top view of the blade and a portion of the handle of the present invention.
Figure 1:
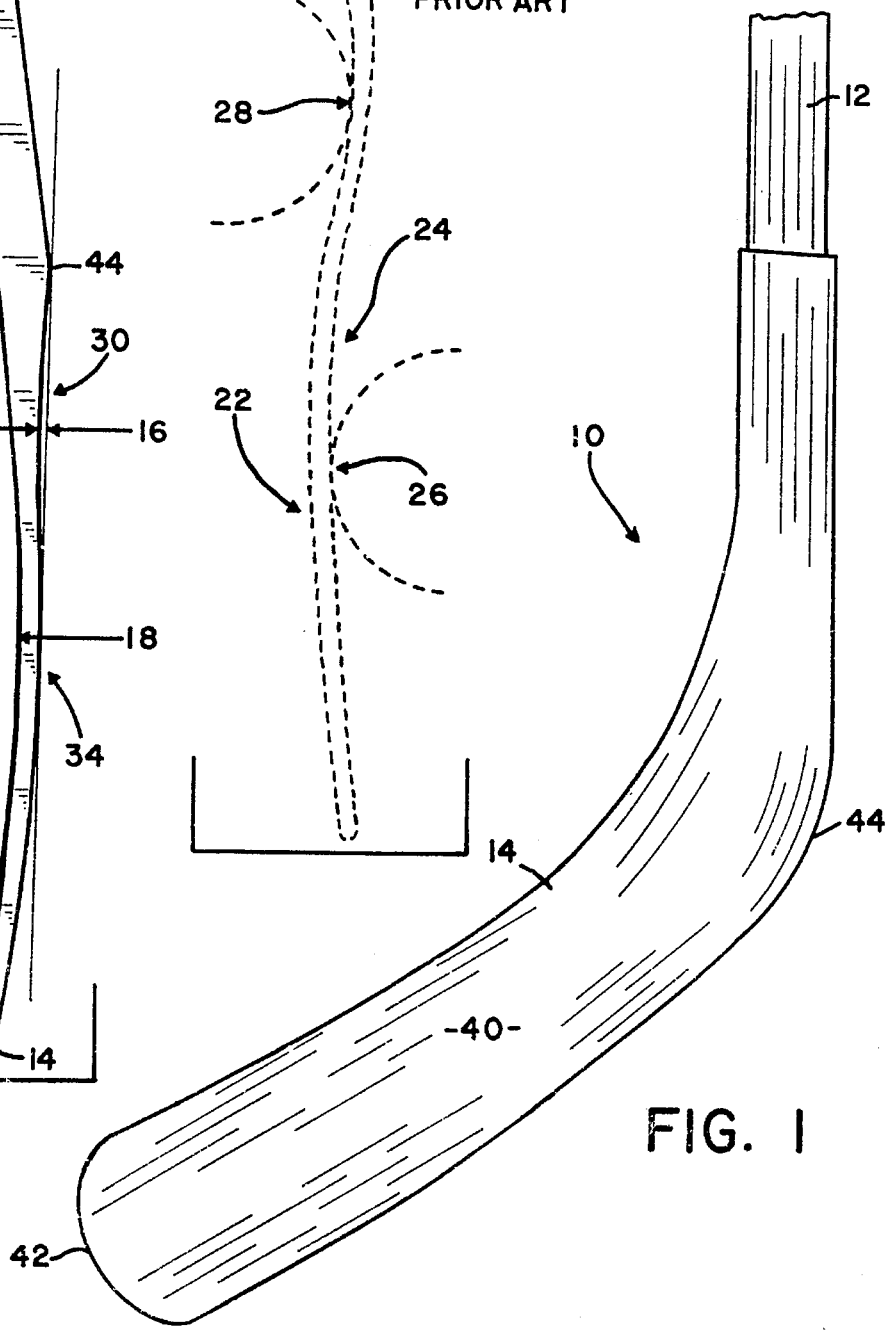
FIG. 1 is a side view of the blade and a portion of the handle of the present invention.

Referring now in detail to the drawings wherein like characters represent like elements throughout the various drawings, in FIG. 1, (10) is an over view of the present invention which is a hockey stick which can be made from substantially any material of engineering choice which is approved by the Rules committee, such as wood or the like, with (12) being a portion of an elongated linear handle and (14) being a blade of predetermined length, having width, thickness, a mid-portion (40) an inner end defining a first heel portion (46) and a second heel portion (44), an outer end toe portion (42), opposed faces respectively defining a forehand side ((32) and a backhand side (34), with the thickness being considerably less than the length of width of the blade and the blade width being substantially constant over its length and the blade having a cross section of substantially uniform thickness over a substantial portion of its length. Referring now to FIG. 2, the distance between arrows (18) represent a first longitudinal concave curve formed on the forehand side of blade (14) beginning at the first heel portion (46) and terminating at the outer end (42), while the distance between arrows (16) represent a second partial curve on the backhand side of the blade (14) beginning at the second heel portion (44) and terminating at substantially the midpoint (40), and each of the curves being substantially opposed to each other with the blade (14) being secured to the elongated linear handle (12) at its inner end and forming an obtuse angle with the handle (12).

It will now be seen that we have developed a partial concave curve on the backhand side of the blade and a longitudinal concave curve on the forehand side of the blade with the longitudinal forehand concave curve extending substantially the entire length of the blade, and each of the curves are formed from the natural construction of the blade, and the blade when so constructed, conforms in all details to the official regulations pertaining to hockey sticks with the valleys of each curve not exceeding the allowed depth.

It will also be seen that we have provided a hockey stick which can be made from substantially any material of engineering choice, such as wood, or the like.

Also, the stick may be made in a left or right configuration and no pocket is created.

Also, at least a portion of the curved forehand side and the curved backhand side of the blade are substantially opposite each other on opposite sides of the blade.

Figure 3:
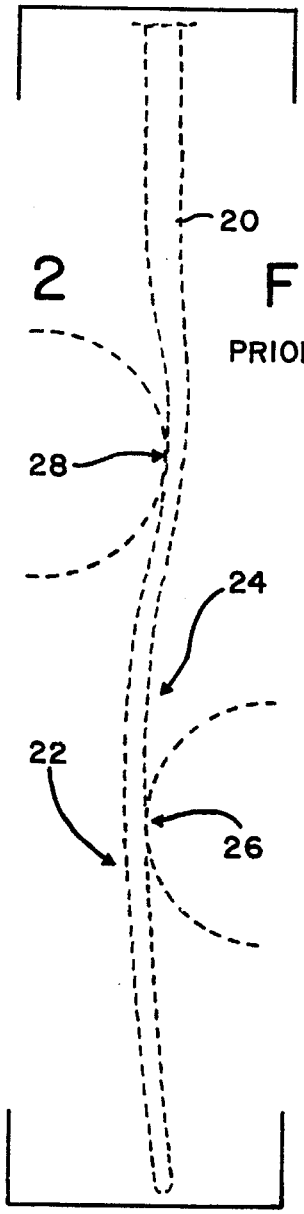
FIG. 3 PRIOR ART
FIG. 3 is a top view of a prior art blade.

One of the advantages of a neutral stick is that in "sticking" that is, handling the puck repeatedly on both sides of the blade, the stick attacks or contacts the puck at the same angle on both sides of the blade and the control of the sight line is controlled by movement of the wrist. With the advent of the curved blade, better sight line control is achieved on the forehand side but at a sacrifice of less control on the backhand side. This has been addressed in the prior art by attempting to create a forehand curved surface and a backhand curved surface and the closest to success is exemplified by the Melby U.S. Pat. No. 4,664,379 which teaches a forehand curved side and a partially curved backhand curved side, however, inherent disadvantages in the placement of the two curves occur as it is not possible to "stick" the puck directly across from either curve without moving the stick laterally, that is toward and away from the player, as the two curves are at no point aligned opposite to each other. Controlling the wrist movement does not help as directly across from each curve on its opposite side is a negative curve instead of the concave portion of a curve. This is clearly illustrated in FIG. 3 which shows the prior art with (20) representing the blade portion of a prior art stick and (22) being the forehand curved side with (24) being the backhand curved side and (26) being a first position of a puck and (28) being a second position of a puck.

Hockey players are taught to "stick" close to the heel of the blade for better control and it will be noted in the present invention that the heel portions (30) & (31) respectively, present two opposite curved portions as illustrated by FIG. 2, with (32) being the forehand curved side and (34) being the backhand curved side. The angle of the stick handle (12) to the playing surface (represented by line (36)) may be changed by moving the stick handle (12) in the direction of the arc shown by arrows (38). By changing this stick position while "sticking", namely, simultaneously alternating the puck back and forth between the forehand curve and the backhand curve with no lateral movement, the "sweet" spot of the blade on "both" sides contacts the puck. This not only improves the line of site in both directions but also allows the player to have improved control of the puck as well as allows the player to have control by only back and forth movement of the wrist, rather than undesirable lateral movement as required by the previously curved hockey sticks as taught by the prior art.

Although the invention has been shown and described in what is conceived to be the most practical and preferred embodiment it is recognized that departures may be made therefrom within the scope and spirit of the invention, which is not to be limited to the details disclosed herein but is to be accorded the full scope of the claims so as to embrace any and all equivalent devices and or apparatus's.

Having described our invention, what I claim as new and wish to secure by Letters Patent is:

1. An integrally formed hockey stick comprising; an elongated linear handle and a blade of predetermined length, width and thickness with the thickness considerably less than the length or width of the blade, the blade width being substantially constant over its length and the blade having a cross section of substantially uniform thickness over a substantial portion of its length, the blade comprising an inner end defining a first heel portion and a second heel portion, an outer end, opposed faces respectively defining a forehand side and a backhand side, a first longitudinal concave curve formed in the forehand side beginning at the first heel portion and terminating at substantially the outer end of the blade, a second longitudinal concave curve formed in the backhand side beginning at the second heel portion and terminating at substantially the midpoint of the blade, the blade being secured to the elongated linear handle at its inner end and forming an obtuse angle with the handle and the curves being substantially opposed to each other.

2. The hockey stick of claim 1 in which said stick is formed in either a right or left hand configuration.

3. An integrally formed hockey stick comprising; a handle and a blade angularly extending therefrom, said blade having; a first longitudinal concave curved forehand side, a backhand side, a first heel portion, a second heel portion, a mid-portion and a toe portion, said first curved forehand side extending substantially from said first heel portion to said toe portion and the curvature formed therefrom being restricted in such a way that the distance of a perpendicular line measured from a straight line drawn from said first heel to said toe to the point of maximum curvature shall not exceed one-half inch, said backhand side having a length substantially equal to said forehand side and a second longitudinal concave curve extending substantially from said second heel portion to said mid-portion and the curvature formed therefrom being restricted in such a way that the distance of a perpendicular line measured from a straight line drawn from said second heel portion to said mid-portion to the point of maximum curvature shall not exceed one-half inch, said length of said backhand side further forming substantially a curve which is substantially parallel to a portion of said first longitudinal concave curve on said forehand side and extends substantially from said mid-portion to said toe portion, and at least a portion of said first curved forehand side being opposite said second longitudinal concave curve on said blade.

4. The hockey stick of claim 3 in which said stick is formed in either a right or left hand configuration.

* * * * *